US005640715A

United States Patent [19]

Adams

[11] Patent Number: 5,640,715

[45] Date of Patent: Jun. 24, 1997

[54] HIDEABLE PROTECTIVE FRONT MEMBER FOR CLOTHING

[75] Inventor: Juel S. Adams, Roanoke, Va.

[73] Assignee: Flip N'Wear, Charlotte, N.C.

[21] Appl. No.: 396,827

[22] Filed: Mar. 2, 1995

[51] Int. Cl.[6] ..... A41B 13/08; A41B 13/10; A41B 1/18; A41D 27/12

[52] U.S. Cl. ..... 2/46; 2/49.1; 2/49.5; 2/119; 2/120; 2/121; 2/105; 2/106; 2/114

[58] Field of Search ..... 2/46, 48, 49.1, 2/49.2, 49.3, 49.4, 49.5, 50, 51, 52, 75, 104, 105, 106, 139, 114, 115, 118, 119, 120, 121

[56] References Cited

U.S. PATENT DOCUMENTS

| | | | |
|---|---|---|---|
| Re. 33,966 | 6/1992 | Robison . | |
| 589,912 | 9/1897 | Stern | 2/119 |
| 760,142 | 5/1904 | Nelson | 2/119 |
| 2,262,010 | 11/1941 | Kuehne | 2/48 X |
| 2,425,635 | 8/1947 | Nitzberg | 2/75 |
| 2,556,039 | 6/1951 | Landert | 2/119 X |
| 3,984,876 | 10/1976 | Sutton . | |
| 4,343,046 | 8/1982 | Zebell | 2/106 X |
| 4,639,946 | 2/1987 | Koening . | |
| 4,754,500 | 7/1988 | Brucato et al. | 2/48 X |
| 5,015,865 | 5/1991 | Sayers . | |
| 5,075,897 | 12/1991 | Daniels | 2/49.4 X |
| 5,107,545 | 4/1992 | Potter . | |
| 5,146,626 | 9/1992 | Rosado | 2/119 X |
| 5,184,351 | 2/1993 | Benstock . | |
| 5,267,710 | 12/1993 | Karmin . | |
| 5,325,538 | 7/1994 | Schoenweiss et al. . | |
| 5,343,565 | 9/1994 | Berni . | |
| 5,432,952 | 7/1995 | Tate | 2/46 X |

*Primary Examiner*—Jeanette E. Chapman

[57] ABSTRACT

A garment is provided which is capable of being moved between a folded up position and a folded down position. In the folded up position, a false front simply appears to be the front of a regular garment. In this position, the bib is attached to a torso covering means by at least one fastener. A separate attachment holds the bib to the torso covering means substantially along the waist of the wearer. In the folded down position, however, a lined bib is provided which gives a measure of protection against spills of beverages, foods, paints, compounds, elements, industrial substances, and so on. In this position, the waist portion attachment is engaged, while the fasteners are disengaged.

2 Claims, 7 Drawing Sheets

HIDEABLE PROTECTIVE FRONT MEMBER FOR CLOTHING

FIELD OF THE INVENTION

The present invention relates to an article of clothing, and in particular to an article of clothing with a removable and/or replaceable protective front member. The front member may be folded down to provide the wearer with a measure of protection against, e.g., spills. In particular, the folded down garment, functioning as a bib, permits the wearer to provide, e.g. food service functions to those persons who have difficulty feeding themselves. Alternatively or complementarily, the garment may be worn by the person having difficulty feeding themselves. When the garment is in the folded up position, i.e., not functioning as a bib, it may provide an aesthetically pleasing pattern similar or complementary to the remainder of the garment.

Whereas throughout this specification the invention is referred to as a bib, those skilled in the art will be aware that the invention may pertain to much more than the common definition of bib. For example, the invention may protect against spills in a research or industrial environment, paint spills, food or beverage spills, etc.

BACKGROUND OF THE INVENTION

Various garments in the prior art have provided for false fronts. Such false fronts allow special purposes to be accomplished by a particular garment.

For example, U.S. Pat. No. 5,015,865 to Sayers provides for an X-ray protective surgical garment. The forward section of the garment adheres to the rearward section by Velcro™ strips.

Similarly, U.S. Pat. No. 4,639,946 to Koenig provides a restraining garment with a detachable bib. While this bib serves the purpose of facilitating cleanup subsequent to the feeding of a toddler, it primarily protects the toddler's torso and does little to protect the toddler's lap. Nor does it provide any sort of clothing function. That is, it serves as a bib that need not be tied on, but does not provide a convenient and integral part of the garment.

Therefore, there is a need for a bib that provides protection over a large surface area, has provisions such that it does not detract from the aesthetic appeal of the garment, and can be easily stored or replaced as required in the future.

SUMMARY OF THE INVENTION

A garment according to an embodiment of the present invention provides a bib capable of being folded between a folded up position and a folded down position. In the folded up position, the bib appears to be merely part of a typical garment. In the folded down position, the bib protects the wearer from spills or certain other mishaps. The garment has a torso covering means having at least a portion defining a waist. Typical torso covering means may be shirts, dresses, robes, undergarments, sweatshirts, and so on. A first fastener is attached to the torso covering means. A bib is attached to the torso covering means at a position substantially near the waist portion of the torso covering means. A second fastener is attached to this bib, and complementarily engages the first fastener when the bib is in the folded up position. The second fastener is disengaged from the first fastener when the bib is in the folded down position. In the folded down position, the combination of the torso covering means and the bib provide a protection against spills, or against certain other mishaps which may stain the garment. Typical first and second fasteners which may be used include complementary Velcro™ strips, buttons and holes, hooks, ties, and so on. Where the bib is attached to the torso covering means, i.e., near the waist portion, it may be attached by a sewn seam. Alternatively, it may be attached by a complementary Velcro™ strip, or it even may be attached by a button and hole combination. When in the down position, the visible portion of the bib, as well as the area of the general front of the torso covering means covered by the bib when the bib is in the folded up position, herein denoted the torso-protected area, may include a liner designed to prevent liquid from entering the fabric of the garment and furthermore designed to be able to accommodate high temperatures in case such products get spilled on the bib or torso-protected area means.

In another embodiment of the invention, the garment may include torso covering means as well as two flaps extending from the torso covering means. The two flaps and the torso covering means have portions cut out such that a substantially circular hole is defined suitable for accepting the neck of a wearer. Adjacent portions of the flaps, which meet near the shoulder blades of the wearer, may include complementary fasteners so as to allow the engagement of the fasteners to maintain the neck hole in a substantially circular shape. When it is desired to remove the garment, the fasteners are simply disengaged, allowing the garment to be removed from the neck of the wearer. The fasteners on the flaps may include Velcro™ strips, a button and hole combination, ties, hooks, and so on. In a further embodiment, a garment according to the present invention may include torso covering means, bib means attached to the torso covering means along at least one edge, and a fastener detachably coupling a portion of the bib means to the torso covering means. In such an embodiment, the bib means may be attached to the torso covering means by a sewn seam. A typical fastener may be a set of complementary Velcro™ strips.

BRIEF DESCRIPTION OF THE DRAWINGS

FIG. 6c shows the detached bib of the embodiment of FIG. 6a.

DETAILED DESCRIPTION

Figure 1A:
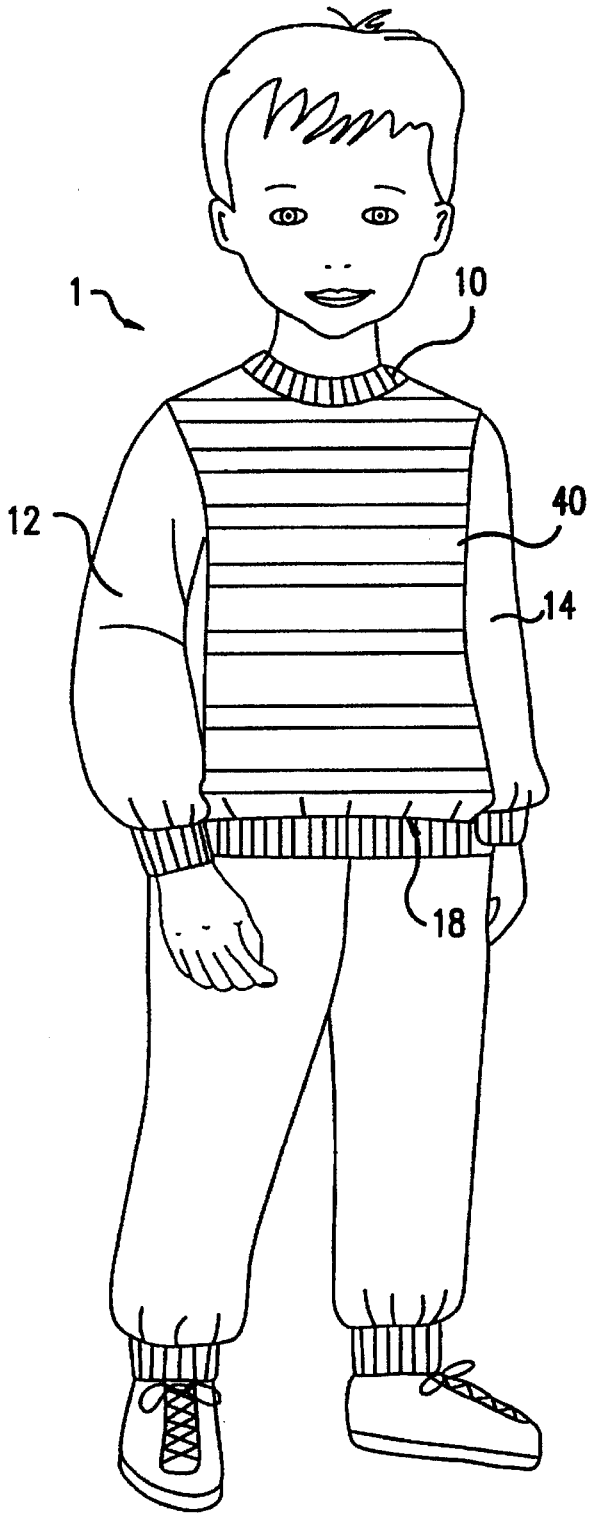
FIG. 1*a* shows an embodiment of a garment of the present invention, where the bib is in the folded up position.
Figure 1B:
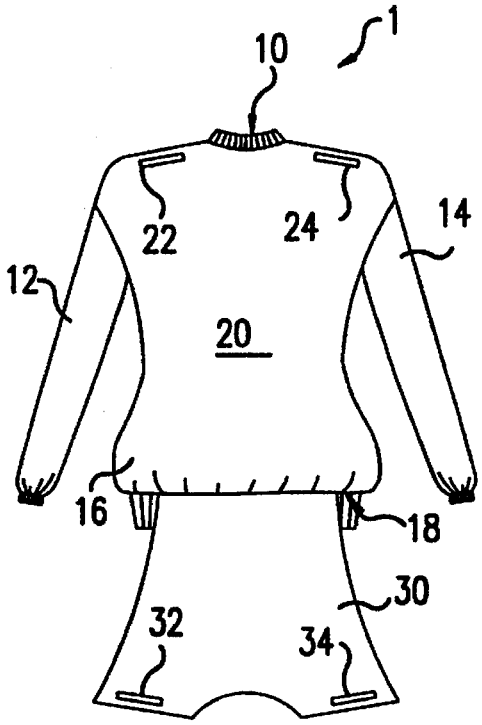
FIG. 1*b* shows an embodiment of a garment of the present invention where the bib is in the folded down position, showing the fasteners.

FIGS. 1a and 1b show the basic structure of an embodiment of the invention. The embodiment in FIG. 1 may be worn by, for example, either a child or an adult. Also, such a garment may be worn by both males and females. As shown in FIG. 1a, garment 1 is shown as a shirt or sweatshirt. As such, the garment has a central torso covering 20 and two arms denoted as 12 and 14. In FIG. 1a, the neck opening is surrounded by an optional collar 10. Also shown in the figure are optional ribbed cuffs surrounding the wrist and an optional ribbed waistband surrounding the waist. It should be noted, of course, that any such suitable elements may be substituted for the collar 10 and the elements surrounding the wrists and the waist.

The fabric usable in the invention may be any fabric capable of being sewn into a garment. However, the fabric may advantageously be lightweight for the comfort of the wearer. Furthermore, it may be bonded with or without water repellant liners. As the fabric may be called upon to survive a spill of possibly hot temperature liquids or solids, it should generally be durable and capable of withstanding high temperatures.

While shown herein in FIG. 1a as a sweatshirt-type top, the invention may be embodied in dresses, aprons, robes, jackets, coats, sweaters, gowns, pajamas, jumpsuits, shirts, and so on.

The shirt's torso portion 20 lies next to the bib portion 30 when the bib is in the folded up position. In FIG. 1b, the bib portion 30 is shown in its folded down position, as it may be used as a bib. In particular, both torso portion 20 and bib portion 30 may be used to protect the wearer from spills. Torso portion 20 is attached to bib portion 30 at waist seam 18. In use, bib portion 30 is folded down over the wearer's lap to prevent solids or liquids from impinging on the wearer's lap and possibly staining them or causing burns. To this end, torso portion 20 and bib portion 30 may be lined with a suitable liner that can withstand high temperatures and be resistant to staining. For example, vinyl would make a suitable liner, as would other fabrics such as polymer-based fabrics. However, any such fabric that is resistant to liquids and can withstand high temperatures as may be found in food or beverage products may be used.

When the bib portion is in the folded down position, as shown in FIG. 1b, as herein discussed, the wearer would be protected from spills or the like of any substances. For example, such a garment would be useful against food or cooking spills, spills in a research or industrial environment, or even those due to painting or coloring, or in any other situation where an apron is being utilized.

When the bib 30 is in the folded up position, as shown in FIG. 1a, front portion 40 is visible and bib portion 30 is hidden. Instead of having a liner, front portion 40 may have a design similar or complementary to that present on the rest of the garment. To maintain the bib portion 30 and front portion 40 in the folded up position, fasteners are present on the torso portion 20, as shown by elements 22 and 24. Complementary fasteners are present on the bib portion 30, as shown by fasteners 32 and 34. The fasteners in FIG. 1b are shown to be of the Velcro™ type. However, fasteners such as hooks, loop-ties, zippers, buttons, snaps, and so on, may also be used.

Figure 2A:
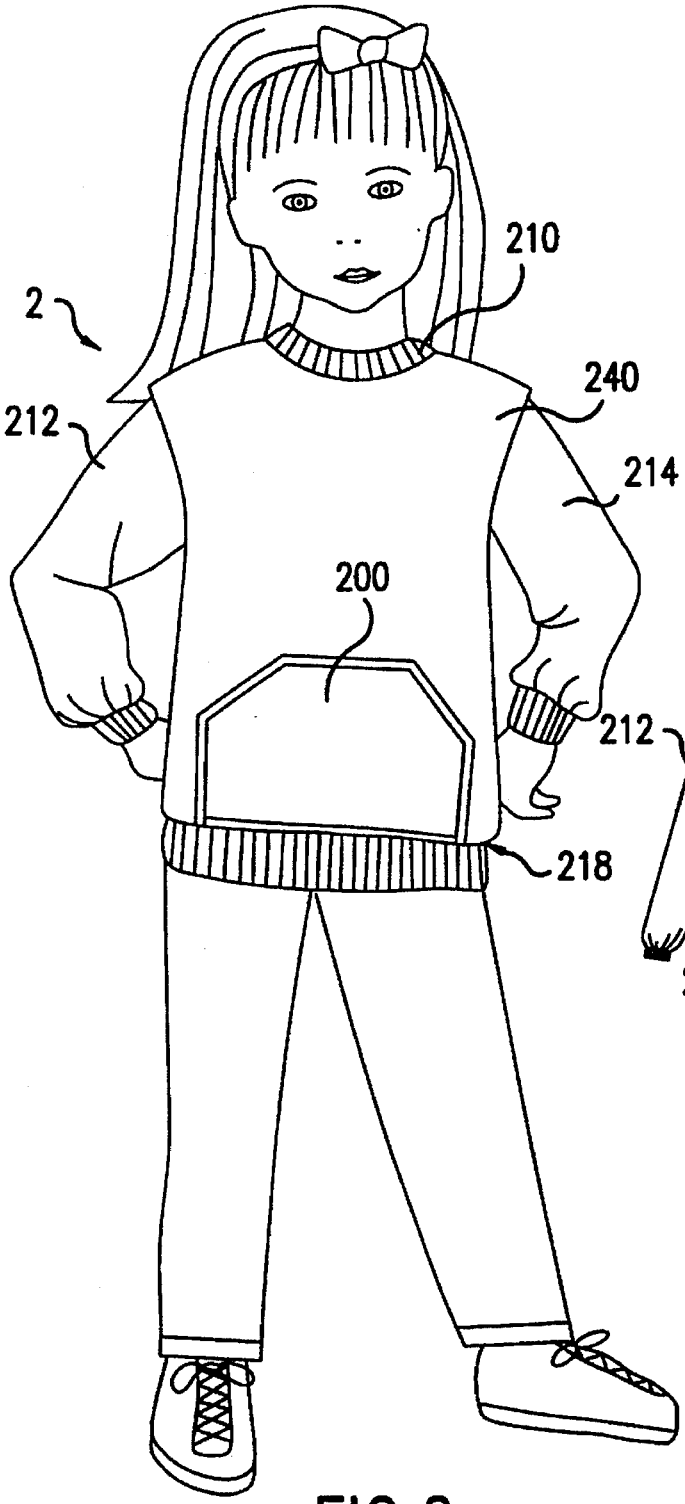
FIG. 2*a* shows another embodiment of a garment of the present invention showing a different style blouse.
Figure 2B:
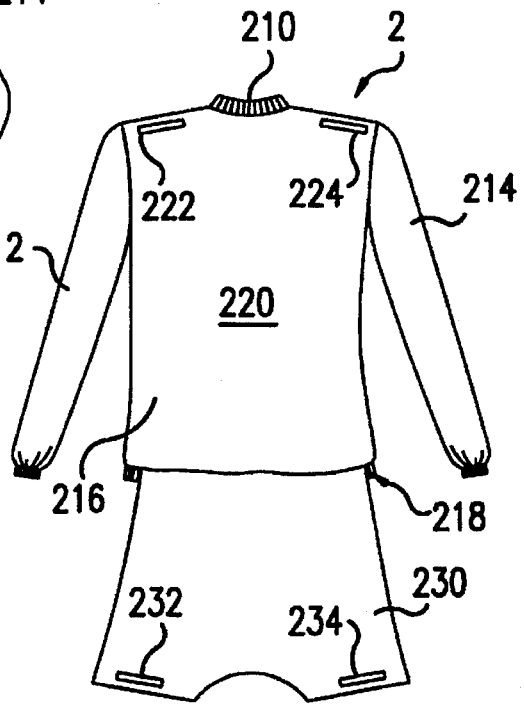
FIG. 2*b* shows an embodiment of a garment of the present invention with the bib in the folded down position, this figure also showing the fasteners.

FIG. 2b shows a similar garment having a torso portion 220 and arms 212 and 214. Collar 210 surrounds the neck. Seam 218 holds the bib portion 230 to the torso portion 220. Fasteners 222 and 224 complementarily engage fasteners 232 and 234 on the bib portion when it is desired to put the bib in the folded up position.

In the embodiment of FIG. 2b, the bib is in the folded down position as it would be used during eating or drinking.

FIG. 2a shows the bib in its folded up configuration. In this figure, the front portion 240 is apparent, which may have a design or pocket such as element 200.

Figure 3A:
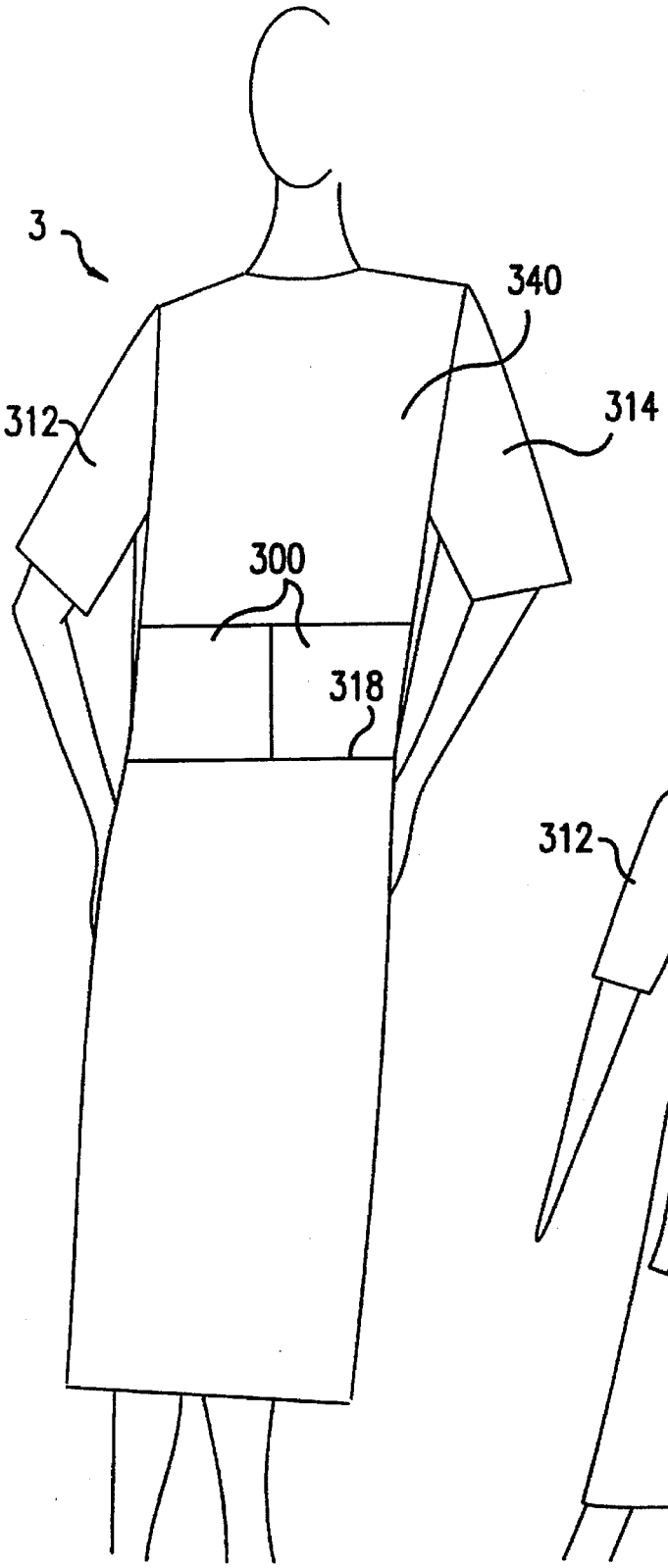
FIG. 3*a* shows an embodiment of a garment of the present invention as the garment may be used in an adult dress.
Figure 3B:
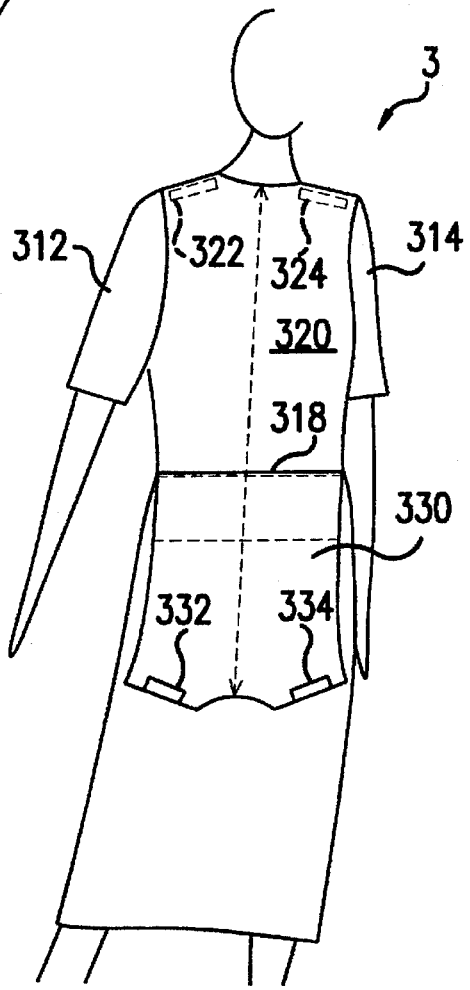
FIG. 3*b* shows an embodiment of a garment of the present invention, as the garment may be embodied in an adult dress, this figure showing the bib in a folded down position.

FIG. 3b shows an embodiment of the invention embodied in an adult dress. As shown in the figure, torso portion 320 is flanked on either side by arms 312 and 314. The bib portion 330 and the torso portion 320 are preferably lined or bonded with a suitable component. For example, a liner may be sewn into the bib or a liquid-impervious component may be bonded to the same. The panel or bib 330 is attached to the torso portion along seam 318. In this figure, therefore, it is directly sewn into the construction of the garment. As shown in FIG. 3b, the fold-down panel or bib is in the down position as it would be during eating, drinking, serving, or whenever desired for torso and lap protection. In this figure, one can see the fasteners 322 and 324 on the torso portion 320, which complementarily engage fasteners 332 and 334 on the bib portion 330 when the bib is in the folded up position.

The folded up position is shown in FIG. 3a. As shown therein, front portion 340, which is on the opposite side of bib portion 330, is visible to the user while bib portion 330 is hidden. At least one pocket, 300, may also be provided as shown in FIG. 3a and 3b. Such pockets may be provided for the convenience of the wearer.

Figure 4A:
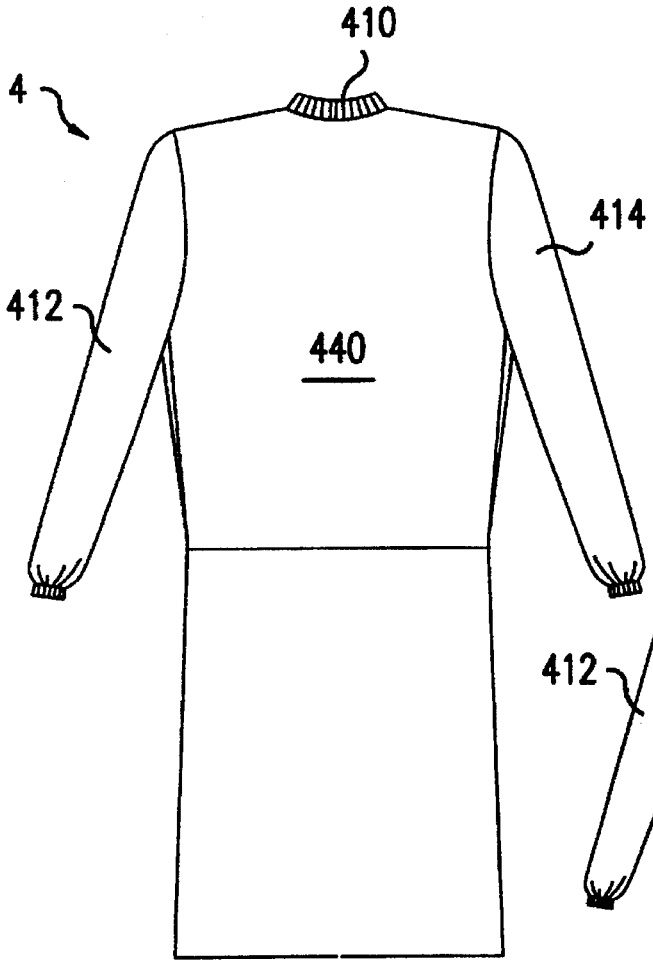
FIG. 4*a* shows an embodiment of a garment of the present invention as the invention may be embodied in an adult dress with ribbed collar and cuffs.
Figure 4B:
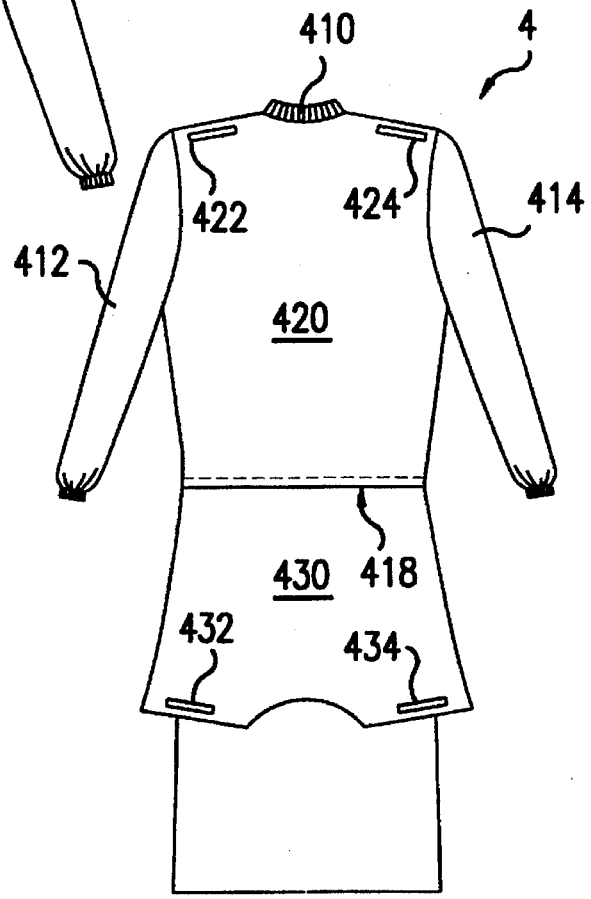
FIG. 4*b* shows an embodiment of a garment of the present invention, as the invention may be embodied in an adult dress with ribbed collar and cuffs, this figure showing the bib in a folded down position.

Another embodiment of the invention is shown in FIG. 4a and 4b. In this embodiment, the invention is shown as an adult dress with ribbed collar and cuffs. The torso portion 420 is flanked by sleeves 412 and 414. FIG. 4b shows the bib portion 430 in the folded down position, while FIG. 4a shows the bib portion in the folded up position. In FIG. 4b, fasteners 422 and 424 are visible which are provided on torso portion 420. These complementarily engage fasteners 432 and 434 provided on bib portion 430 when it is desired to place the bib in the folded up position.

However, in this embodiment and in all others, there is no requirement that there be two fasteners. In fact, there may be more or less. In general, however, it is found that having the same number of fasteners on the torso portion as on the bib portion is preferable.

As shown in FIG. 4b, bib portion 430 is mounted to torso portion 420 by virtue of seam 418.

Figure 5A:
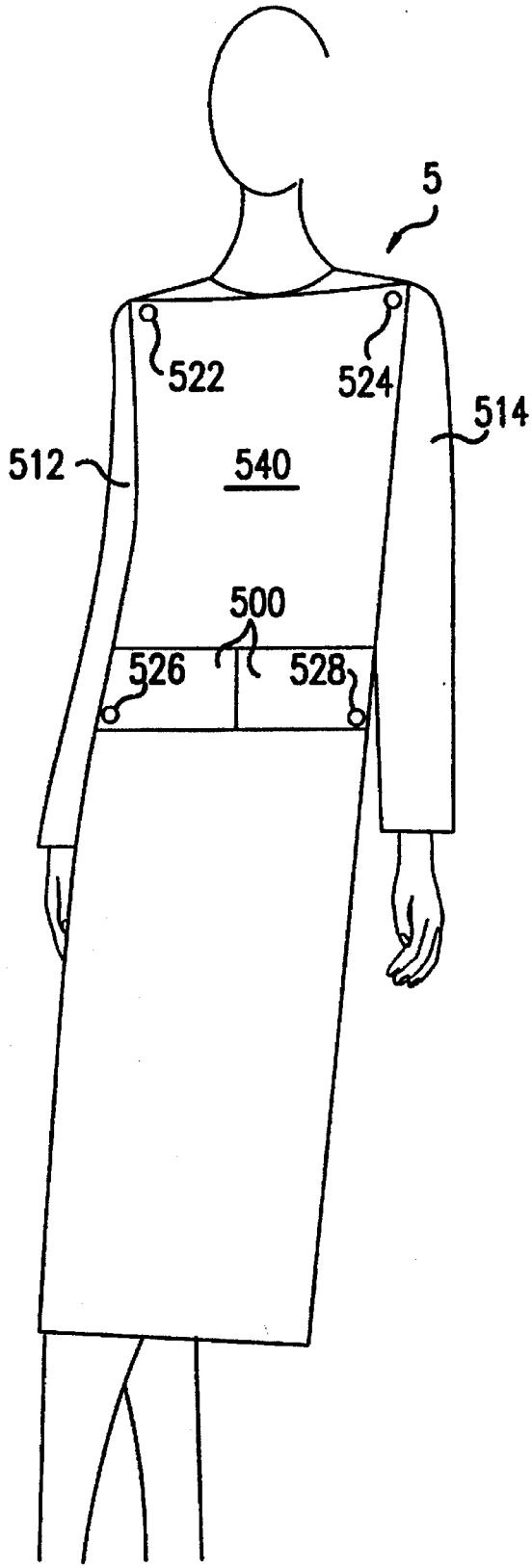
FIG. 5*a* shows an embodiment of a garment of the present invention, as the invention may be embodied in an adult dress, this figure showing fasteners which may attach a detachable bib to the garment.
Figure 5B:
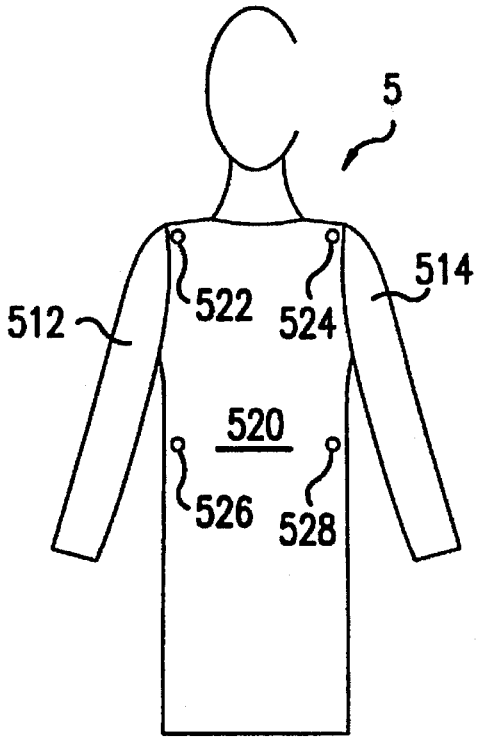
FIG. 5*b* shows the garment of FIG. 5*a* with the bib detached.
Figure 5C:
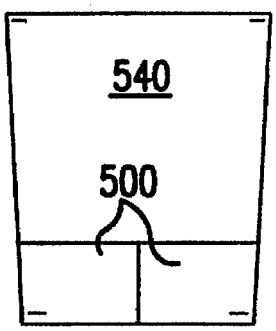
FIG. 5c shows the garment of FIG. 5a, this figure only showing the bib in its detached form.

FIG. 5 shows an embodiment of the invention with a detachable panel or bib 540. The basic garment without a bib is shown in FIG. 5b. In this figure, torso portion 520 is flanked by sleeves 512 and 514. Garment 5 also has four fasteners shown, 522, 524, 526, and 528 on which may be mounted bib 540. However, there is no minimum or maximum number of fasteners which may be used. FIG. 5*c* shows the detachable bib 540 on which is mounted, in this embodiment, pockets 500. However, the number of pockets and/or the existence of pockets may vary from garment to garment. FIG. 5*a* shows bib 540 mounted onto garment 5. In FIG. 5*a*, buttons 522, 524, 526, and 528 extend through the bib portion 540 so as to detachably mount it to garment 5. As before, buttons may be replaced by Velcro™ strips, hooks, loop-ties, zippers, and so on.

Figure 6A:
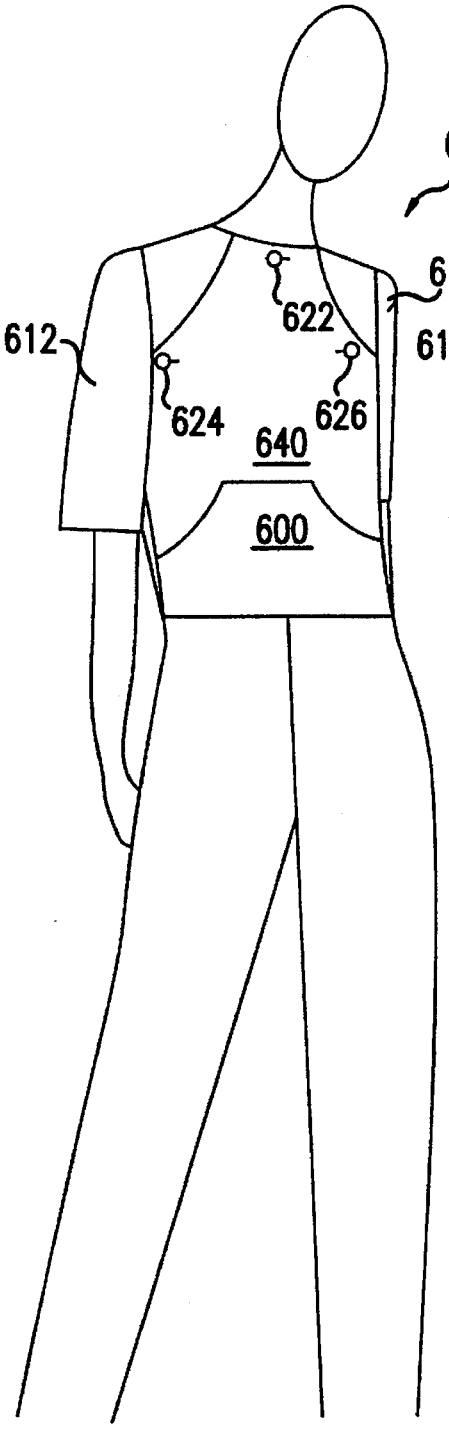
FIG. 6a shows an embodiment of a garment of the present invention as the invention may be embodied in a blouse with a detachable bib having three fasteners.
Figure 6B:
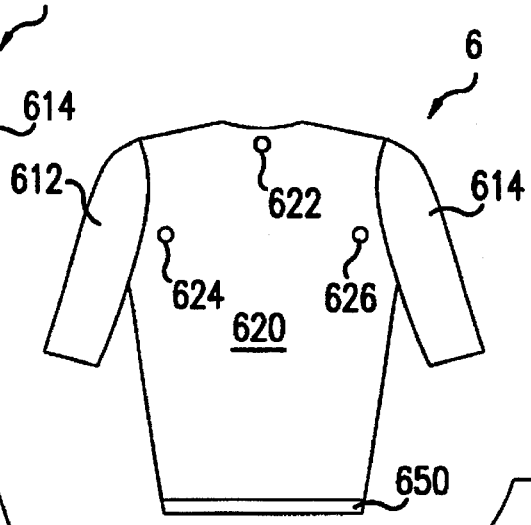
FIG. 6b shows the embodiment of FIG. 6a with the bib detached.
Figure 6C:
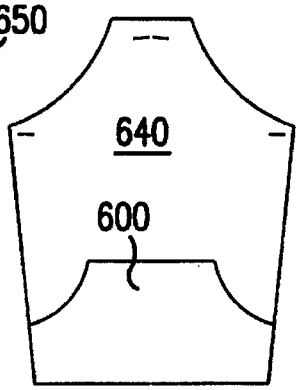

FIG. 6*a* shows a further embodiment of a garment of the present invention with another detachable panel or bib. In particular, this embodiment shows a shirt which may be worn with pants, a skirt, a dress, or a coat or jacket. Shirt 6 is constructed, as shown in FIG. 6*b*, with three buttons, 622, 624, and 626 mounted onto torso portion 620. Shirt 6 also has two sleeve portions 612 and 614. Finally, shirt 6 has a Velcro™ portion 650 around at least a portion of the waist. Bib portion 640 is shown in FIG. 6*c*. In this figure, a pocket 600 is shown as constructed and attached to bib 640. FIG. 6*a* shows the bib portion 640 mounted to garment 6. As such, buttons 622, 624, and 626 extend through buttonholes in bib 640, and Velcro™ strip 650 is engaged to a corresponding Velcro™ strip on 640 (not shown). The embodiment of FIG. 6*a* may be particularly appropriate for a blouse or shirt for an adult.

Figure 7A:
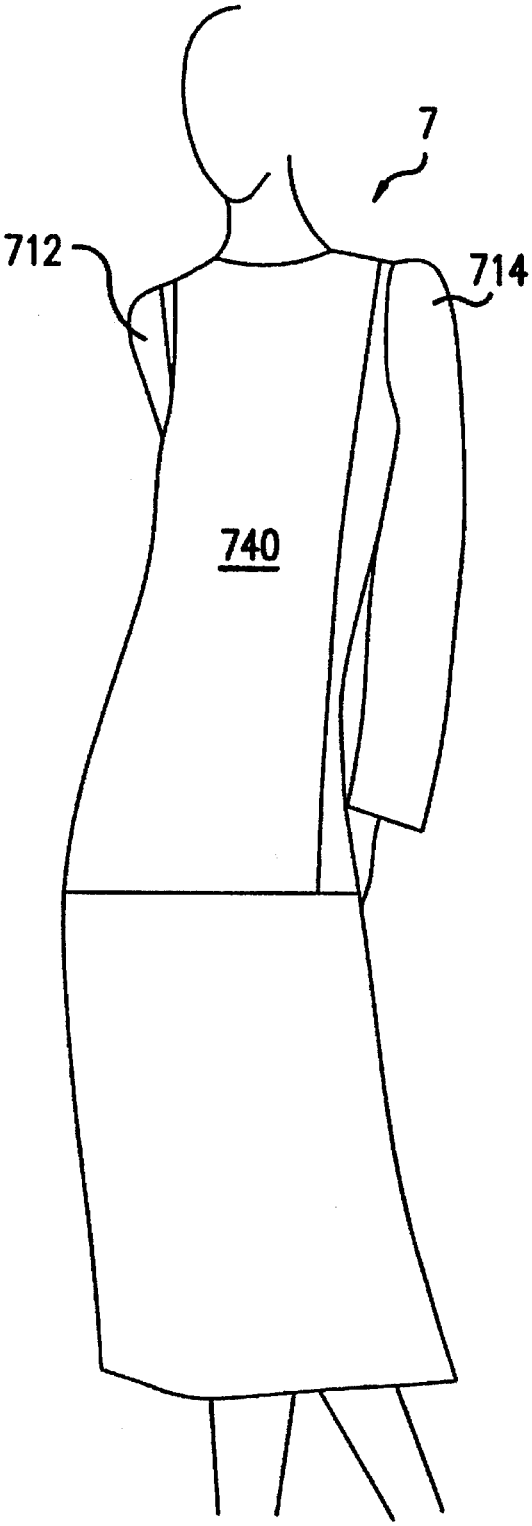
FIG. 7a shows an embodiment of a garment of the present invention where the fasteners are provided in the back of the garment.
Figure 7B:
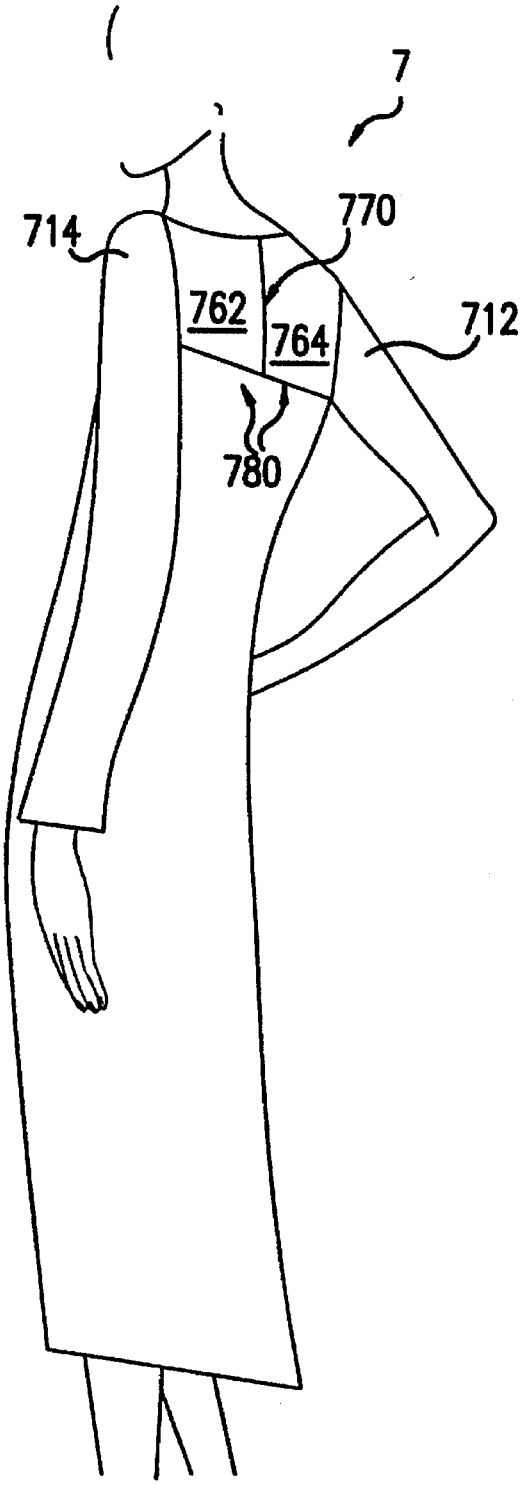
FIG. 7b shows the back side of the garment embodied in FIG. 7a, indicating where the optional fasteners might be located.

FIG. 7*a* and 7*b* show yet another embodiment of the invention. In particular, they show a bib which may be worn over the top of a dress. In this figure, garment 7 is shown with sleeves 712 and 714. Over the top of the general torso portion of the dress is shown bib 740. Bib 740 generally overlies the torso portion, and is attached behind the user or wearer in the general portion of the shoulder blades. For example, flaps 762 and 764 may overlap each other and may be provided with complementary Velcro™ strips along seam 770, or along seam 780, or both. If the Velcro™ strips are provided along seam 770, then the bib is simply attached along seam 770, and the user's neck prevents the bib from falling downward in front of the wearer. Alternatively, as an example, Velcro™ strips could be provided along seam 780, in which case the flaps 762 and 764, or equivalently a single flap (not shown) may attach to strip 780 to hold bib 740 onto the user in a positive fashion.

Of course it should be noted that in the above example the use of Velcro™ strips has been alluded to. However, other fasteners could also be used, as are known in the art, for example, hooks, loop-ties, zippers, buttons, snaps, and so on, could also be used.

Finally, it should be noted that one skilled in the art could envision variations of the above. The examples given herein are merely exemplary and the scope of the application is to be limited only by the claims appended hereto.

What is claimed is:

1. A garment with a bib comprising:

a) a garment for covering the upper part of the torso having at least a portion defining a waist, said garment lined on the outside with a material impervious to liquid;

b) a first fastener attached to said garment located in an upper part of said garment distal from the waist;

c) a bib attached to said garment by a sewn seam substantially near said waist portion, said bib comprising:

i) a front portion with a design made to complement the rest of the garment;

ii) a back portion lined with a material impervious to liquid; wherein said material impervious to liquid lining said garment and said bib is hidden from view when said bib is folded up in a first position against said garment, and wherein said material impervious to liquid lining said garment and bib is exposed to protect the wearer when said bib is folded down in a second position away from said garment;

d) a second fastener attached to said bib, said second fastener arranged for complementary engagement with said first fastener to maintain said bib in said first position against said garment, and arranged to release said bib when said bib is folded down in said second position away from said garment.

2. The garment with a bib of claim 1, wherein said material impervious to liquid is a polymeric material.

* * * * *